United States Patent [19]

Tran et al.

[11] Patent Number: 4,705,988

[45] Date of Patent: Nov. 10, 1987

[54] DEVICE FOR GUIDING AN ELECTRON BEAM

[75] Inventors: Minh Q. Tran, Lausanne, Switzerland; Anders Bondeson, Gothenburg, Sweden

[73] Assignee: Centre de Recherches en Physique des Plasma (CRPP), Lausanne, Switzerland

[21] Appl. No.: 773,665

[22] Filed: Sep. 9, 1985

[30] Foreign Application Priority Data

Oct. 2, 1984 [CH] Switzerland ..... 4727/84

[51] Int. Cl.[4] ..... H01J 25/00

[52] U.S. Cl. ..... 315/4; 315/3; 315/5; 333/228; 372/19

[58] Field of Search ..... 315/3, 4, 5; 372/19, 372/102, 103; 333/228

[56] References Cited

U.S. PATENT DOCUMENTS

| | | | |
|---|---|---|---|
| 4,387,467 | 6/1983 | Kirby | 333/228 |
| 4,398,121 | 8/1983 | Chodorow et al. | 315/4 |
| 4,494,039 | 1/1985 | Kim | 315/4 |
| 4,516,243 | 5/1985 | Utaka et al. | 372/19 |
| 4,531,103 | 7/1985 | Evans et al. | 315/5 |
| 4,540,960 | 9/1985 | Giordano | 333/228 |
| 4,561,721 | 12/1985 | Keilmann et al. | 372/102 |
| 4,604,551 | 8/1986 | Moeller | 315/5 |

FOREIGN PATENT DOCUMENTS

| | | | |
|---|---|---|---|
| 0113240 | 9/1980 | Japan | 315/4 |
| 2152740A | 8/1985 | United Kingdom | 315/5 |

*Primary Examiner*—Saxfield Chatmon

*Attorney, Agent, or Firm*—Oblon, Fisher, Spivak, McClelland & Maier

[57] ABSTRACT

A device for guiding an electron beam from an electron gun to a microwave resonator in a microwave source operating according to the gyrotron principle, including a beam duct for guiding the electron beam, wherein the beam duct encloses the electron beam and has an electrically highly conductive surface area. For damping unwanted wave modes inside the beam duct, a plurality of damping openings are provided in the surface area of the beam duct. The characteristic aperture size (a) of the damping openings is larger than the wavelength of the modes to be damped. A particularly simple implementation employs wire mesh with an appropriate mesh size used as the material for the surface area of the beam duct.

15 Claims, 4 Drawing Figures

DEVICE FOR GUIDING AN ELECTRON BEAM

BACKGROUND OF THE INVENTION

1. Field of the Invention

The present invention relates to a device for guiding an electron beam in a microwave source operating in accordance with the gyrotron principle.

2. Discussion of the Background

Such a device as above noted is known, for example, from the article by J. D. Silverstein et al. in Int. J. Electronics 53 (6), pages 539–546 (1982).

In a gyrotron as described in the abovementioned article, a high-energy electron base originating from an electron gun is sent through a strong magnetic field which is oriented parallel to the beam axis. The electrons then pass along spiral paths around the beam axis at a cyclotron frequency which is a function of the magnetic inductance.

If then this beam of circulating electrons crosses through a microwave resonator of suitable dimensions, electromagnetic oscillations are excited in the resonator which can be coupled out of the resonator.

For guiding the electron beam from the electron gun to the microwave resonator, which is constructed as a cavity resonator in the gyrotron, a beam duct is used which encloses the beam as an electrically conductive cylindrical surface area and, by limiting space charge effects, enables the electron beam to propagate unhindered.

The surface area, closed in the radial direction, of a beam duct according to the prior art, however, represents a wave guide. At high frequencies (of the order of magnitude of 100 GHz) and high powers (of the order of magnitude of 100 kw), the radius of the electron beam is large in comparison with the cut-off wavelength of the circular wave guide mode at the operating frequency. For this reason, unwanted wave modes can be excited in the beam duct unless suitable measures are taken for damping such modes.

As a suitable damping measure, it is known to provide stacks of annular plates along the beam axis inside the beam duct which plates consist alternately of absorbing ceramics (for example SiC-based) and highly conductive copper (see for example FIG. 5 in the initially quoted printed document).

However, such a beam duct containing stack-shaped integrated wave filters has a complicated structure and its manufacture is associated with considerable expenditure.

The gyrotron of known construction, shown in FIG. 1, for generating high-power microwaves essentially comprises an electron gun 1, a beam duct 5, a cavity resonator 6 and an output wave guide 7. The parts enumerated are housed in a vacuum chamber, not shown, and enclosed by a solenoid coil, also not shown, which generates the strong magnetic field necessary for the gyrotron effect.

The electron gun 1 emits an electron beam 2. With typically 4 mm, the diameter of the electron beam 2 is kept small for a 120 GHz gyrotron in order to achieve high efficiency in the conversion of beam energy into electromagnetic wave energy.

Due to the high space charge density inside the electron beam 2, connected with the small diameter, space charge effects such as, for example, current limiting or a lowering of the beam potential occur which limit the energy transport in the beam.

To enable the electron beam 2 to propagate unhindered from the electron gun 1 to the cavity resonator 6 in which the interaction between beam and electromagnetic field takes place, the beam duct 5, containing in its interior a stacked sequence of metal rings 3 and ceramic rings 4, is arranged between the two.

This stacked sequence represents a measure for damping unwanted wave modes which can be excited by the electron beam 2 in the closed surface area, acting as a wave guide, of the beam duct 5. The result is that only the wanted electromagnetic waves are excited in the cavity resonator 6 and are coupled out via the output wave guide 7.

SUMMARY OF THE INVENTION

Accordingly, one object of this invention is to provide a novel device of the above noted type, including a beam duct in which the damping of unwanted wave modes is achieved by comparatively simple means.

The above object is achieved according to the invention by providing a novel device for guiding an electron beam from an electron gun to a microwave resonator in a microwave source operating in accordance with the gyrotron principle, including a beam duct formed of an electrically conductive material and defining a surface area which encloses the electron beam along its direction of propagation. Inside the beam duct there is provided means for damping unwanted wave modes, including a plurality of damping openings in the surface area of the beam duct, wherein the characteristic aperture size (a) of the damping openings is larger than or approximately equal to the wavelength of the wave modes to be damped.

An important feature of the present invention consists in the fact that, for the purpose of damping unwanted modes, the damping openings are provided in the surface area of the beam duct and have a sufficiently large aperture to achieve adequate transparency of the surface area for the unwanted modes, whereby corresponding damping is achieved.

It is particularly advantageous in accordance with a preferred illustrative embodiment of the invention, to use wire mesh of electrically highly conductive metal wire and having an appropriate mesh size as the material for the surface area of the beam duct.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
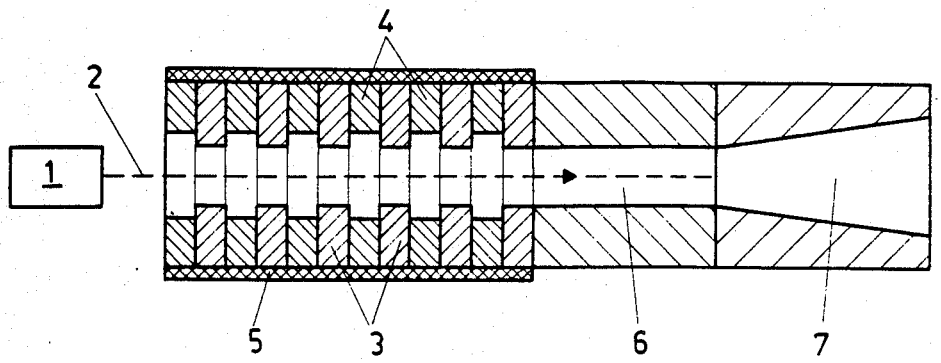
FIG. 1 is a schematic representation, partly in cross-section, of a gyrotron having a damped beam duct according to the prior art.

Referring now to the drawings, wherein like reference numerals designate identical or corresponding parts throughout the several views, and more particularly to FIG. 1 thereof, according to the present invention, a damping of modes in the beam duct 5 is achieved in a much simpler manner compared to the prior art teachings shown in FIG. 1 by providing, instead of the integrated stack of metal rings 3 and ceramic rings 4, a plurality of damping openings in the surface area of the beam duct, which openings permit electromagnetic fields to emerge and thus reduce the natural quality factor Q of the beam duct to a subcritical value.

Figure 2:
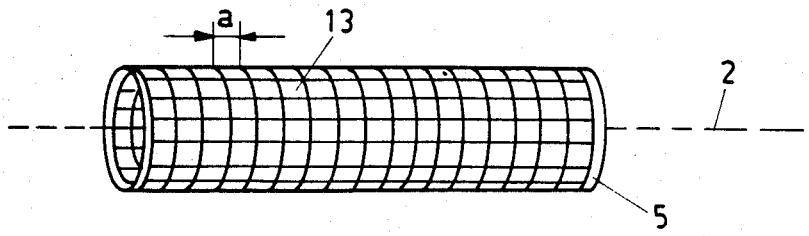
FIG. 2 shows an illustrative embodiment of a beam duct according to the invention for a gyrotron according to FIG. 1.

A preferred illustrative embodiment of a beam duct whose surface area is provided with a plurality of damping openings is reproduced in a perspective view in FIG. 2. In this illustrative embodiment, the beam duct 5 has a cylindrical surface area of a wire mesh or wire net which encloses the electron beam 2. The wire mesh contains the apertures of the mesh or net as damping openings 13. In this arrangement, the characteristic aperture size a of the apertures is selected in such a manner that it is approximately equal to or greater than the wavelength of the wave modes to be damped. On the other hand, it is particularly advantageous in the case of the cylindrical beam duct 5 if the characteristic aperture size a is smaller than half the difference between the radius of the surface area and the radius of the electron beam 2 because the guiding characteristics of the beam duct 5 are particularly distinct in this case. Both dimensioning rules for the characteristic aperture size a can be easily fulfilled for high frequencies above 100 GHz.

The wire mesh of the beam duct 5 from FIG. 2 preferably consists of copper, silver or similar, electrically highly conductive materials. The radius of the cylindrical surface area is between 2 and 8 mm and is typically 5 mm, assuming an electron beam radius of about 2 mm.

The exact cylinder radius is determined by the maximum possible drop in potential of the electron beam. If this cylinder radius is established, the characteristic aperture size a is found from the above-mentioned dimensioning rules.

Apart from the gyrotron, which has been described in the initially quoted printed document and is suitable for wave lengths in the cm range, the quasi-optical gyrotron and the quasi-optical gyroclystron are known as further developments for the millimeter wave range (A. Bondeson et al. in Int. J. Electronics 53 (6), page 547 ff. (1982)).

Figure 3:
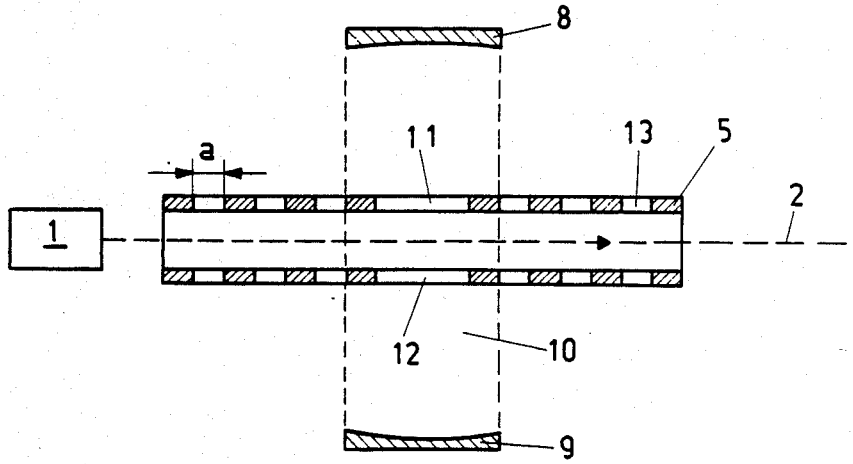
FIG. 3 is a schematic representation, partly in cross-section, of the basic arrangement of a quasi-optical gyrotron having a beam duct according to the invention.

In the quasi-optical gyrotron, which is here used as an example, according to FIG. 3, the electron beam emitted by the electron gun 1 is sent to interact with an electro-magnetic alternating field in a quasi-optical open resonator 10 which consists of two opposite concave resonator reflectors 8 and 9. The geometry of the arrangement here requires that in the surface area of the beam duct 5 which, in the illustrative embodiment of FIG. 3, has through holes as damping openings 13 in a conductive plate (for example of sheet metal), additional through openings 11 and 12 are provided in the area of the open resonator 10 through which openings the resonator waves can pass unhindered.

Figure 4:
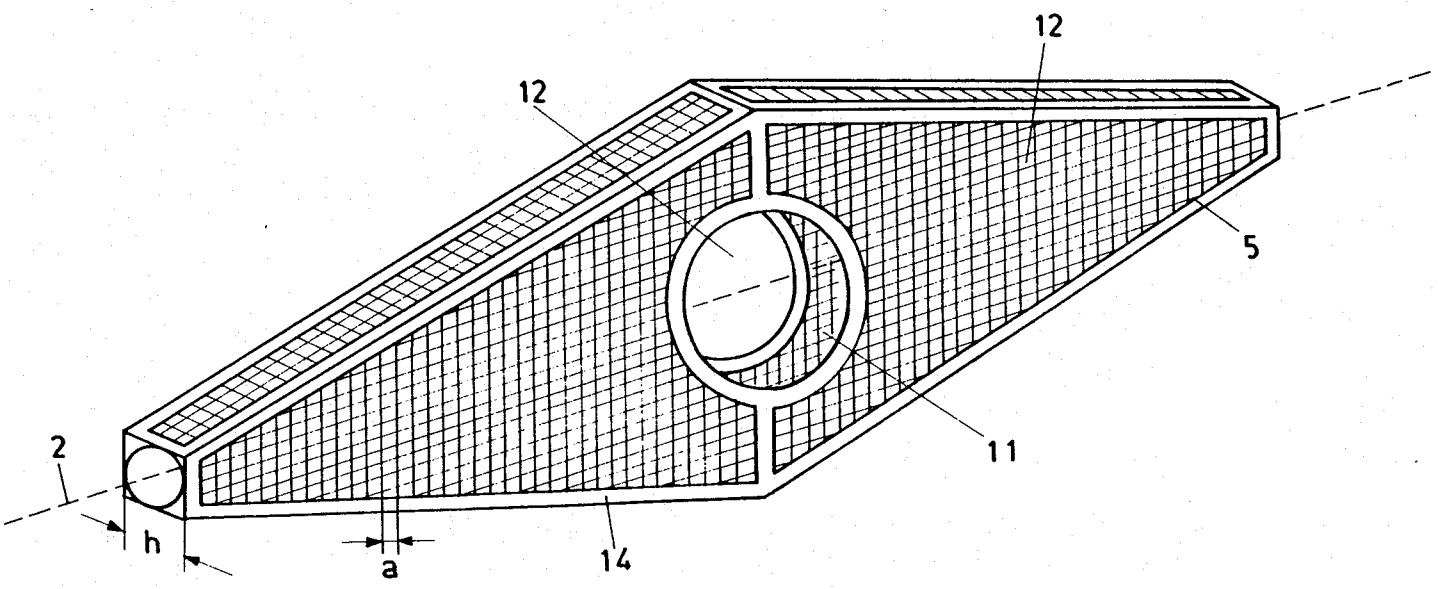
FIG. 4 is a perspective view of an illustrative embodiment of a beam duct according to the invention for a quasi-optical gyrotron according to FIG. 3.

In FIG. 4, the embodiment of a beam duct 5 for a quasi-optical gyrotron according to FIG. 3, in which the surface areas are again produced by wire mesh, is shown in a perspective view. Perpendicular to the axis of the electron beam 2, the beam duct has a rectangular cross section, the height of which is constant and is, for example 10 mm, and the width of which reaches a maximum of, for example, 80 mm at the centre and linearly decreases towards both sides.

The wire mesh of the surface area is preferably held by a frame 14 which imparts the necessary stability to the beam duct 5 and simultaneously limits the through openings 11 and 12 for the waves of the open resonator 10.

The apertures of the wire mesh again form the damping openings 13 the characteristic aperture size a of which is determined in accordance with the dimensioning rules already described.

Analogously, the embodiment of a beam duct for a quasi-optical gyroclystron is produced, with the difference that in the latter through openings for two open, quasi-optical resonators must be provided.

Overall, the invention provides a mode-damped beam duct for gyrotrons which is characterised by a particularly simple and rugged construction and can be produced with correspondingly little expenditure.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for guiding an electron beam from an electron gun to a microwave resonator in a microwave source operating in accordance with the gyrotron principle, comprising:

a beam duct including an electrically conductive wall, said beam duct enclosing the electron beam along a direction of propagation of the electron beam;

means provided inside the beam duct for damping unwanted wave modes, said damping means comprising a plurality of damping openings provided in said wall of said beam duct, said damping openings have a characteristic aperture size (a) which is larger or approximately equal to a wavelength of wave modes to be damped.

2. A device according to claim 1, wherein the beam duct defines a cylindrical surface area and the characteristic aperture size (a) is smaller than or approximately equal to half the difference between the radius of the cylindrical surface area and the radius of the electron beam.

3. A device according to claim 2, wherein the radius of the cylindrical surface area is between 2 mm and 8 mm.

4. A device according to claim 3, wherein the radius of the cylindrical surface area is about 5 mm.

5. A device according to claim 1 for a microwave source having a quasi-optical open resonator, including a pair of opposed resonator mirrors placed on opposite sides of said electron beam, said opposed resonator mirrors each defining a mirror axis which is perpendicular to the direction of propagation of the electron beam, wherein the wall of the beam duct defines a hollow-tube with a rectangular cross-section the sides of which are perpendicular and parallel to said mirror axis, respectively, wherein the wall of the beam duct includes in the vicinity of the open resonator through openings for unhindered passage of resonator waves.

6. A device according to claim 1, wherein the surface area of the beam duct comprises a wire mesh having a mesh size equal to the characteristic aperture size (a).

7. A device according to claim 2, wherein the surface area of the beam duct comprises a wire mesh having a mesh size equal to the characteristic aperture size (a).

8. A device according to claim 3, wherein the surface area of the beam duct comprises a wire mesh having a mesh size equal to the characteristic aperture size (a).

9. A device according to claim 4, wherein the surface area of the beam duct comprises a wire mesh having a mesh size equal to the characteristic aperture size (a).

10. A device according to claim 1, wherein the surface area of the beam duct comprises a sheet metal plate provided with a plurality of through holes having a diameter equal to the characteristic aperture size (a).

11. A device according to claim 2, wherein the surface area of the beam duct comprises a sheet metal plate provided with a plurality of through holes having a diameter equal to the characteristic aperture size (a).

12. A device according to claim 3, wherein the surface area of the beam duct comprises a sheet metal plate provided with a plurality of through holes having a diameter equal to the characteristic aperture size (a).

13. A device according to claim 4, wherein the surface area of the beam duct comprises a sheet metal plate provided with a plurality of through holes having a diameter equal to the characteristic aperture size (a).

14. A device according to claim 6, wherein the beam duct essentially consists of Cu.

15. A device according to claim 10, wherein the beam duct essentially consists of Cu.

* * * * *